US005725197A

United States Patent [19]

Hill

[11] Patent Number: 5,725,197

[45] Date of Patent: Mar. 10, 1998

[54] MAINS PRESSURE FLUSHER VALVE

[75] Inventor: Stephen A. Hill, Donnybrook, Australia

[73] Assignees: Dianna Adele Hill, Caufield; Karen Louise Hill, Brighton, both of Australia

[21] Appl. No.: 731,121

[22] Filed: Oct. 9, 1996

Related U.S. Application Data

[63] Continuation of Ser. No. 284,541, filed as PCT/AU93/00046 Feb. 5, 1993.

[30] Foreign Application Priority Data

Feb. 7, 1992 [AU] Australia ..... PL0752
Sep. 16, 1992 [AU] Australia ..... PL4759

[51] Int. Cl.[6] ..... F16K 31/12

[52] U.S. Cl. ..... 251/44; 251/30.05; 137/614.2

[58] Field of Search ..... 251/44, 30.05; 137/614.2

[56] References Cited

U.S. PATENT DOCUMENTS

| | | | |
|---|---|---|---|
| 2,295,871 | 9/1942 | Sloan et al. | 251/44 |
| 2,882,006 | 4/1959 | Reinecke | 251/30.05 |
| 3,008,682 | 11/1961 | Filliung et al. | 251/44 |
| 3,902,521 | 9/1975 | Keller et al. | 251/44 |

FOREIGN PATENT DOCUMENTS

| | | | |
|---|---|---|---|
| 72779 | 11/1916 | Austria | 251/44 |
| 0 264 638 | 4/1988 | European Pat. Off. . | |
| 714 681 | 11/1931 | France . | |
| 972 332 | 1/1951 | France . | |
| 1 004 107 | 3/1952 | France . | |
| 430 885 | 6/1926 | Germany . | |
| 23 47 524 | 4/1975 | Germany . | |
| 26 09 137 | 9/1977 | Germany . | |
| 27 22 889 | 11/1978 | Germany . | |
| 325 114 | 2/1930 | United Kingdom . | |
| 368985 | 3/1932 | United Kingdom . | |
| 529 659 | 11/1940 | United Kingdom . | |
| 601 969 | 6/1948 | United Kingdom . | |

*Primary Examiner*—A. Michael Chambers
*Attorney, Agent, or Firm*—Kenyon & Kenyon

[57] ABSTRACT

A mains pressure valve including a main chamber having an inlet chamber for fluid and an outlet for fluid, a non-return valve located downstream of the outlet and adapted to provide resistance to fluid flowing therethrough, a piston located in the main chamber which is movable into and out of sealing engagement with the outlet of the main chamber and which defines above it an upper portion of the main chamber and having an internal passageway which communicates between the upper portion of the main chamber and the inlet, a port in the upper portion which permits fluid to flow therethrough, and actuation control associated with the port to regulate the flow of fluid through the port. Upon actuation, fluid in the upper portion drains through the port, allowing the piston to rise and mains pressure fluid passes from the inlet chamber through main chamber and out discharge chamber. The non-return valve provides some resistance to the passage of fluid to reduce the vacuum force created by the passage of fluid at mains pressure. Fluid bleeds via the flow valves into the upper portion and, when the port is closed, piston closes the valve after a predetermined period.

20 Claims, 3 Drawing Sheets

MAINS PRESSURE FLUSHER VALVE

This application is a continuation of application Ser. No. 08/284,541, filed on Aug. 8, 1994, which is a 371 of PCT/AU93/00046 filed Feb. 5, 1993.

FIELD OF THE INVENTION

The invention relates in a main pressure valve for a mains pressure water system which, upon activation, will deliver a predetermined volume of water.

In this description, where the valve is described in respect of water, it will be understood that other fluid could be used with the valve as well.

BACKGROUND

Conventionally, where it is necessary to discharge a predetermined amount of water, a header tank is commonly used with a controlling float valve. Typically, this is required for toilets. The tank is sized to hold a set amount of water. After each discharge the tank needs to be refilled with an attendant delay between flushes. These tanks can be unsightly or otherwise hood to be safeguarded against vandalism and it is common to locate them in the partitioning walls or ceilings of the urinal. Further, particularly in large buildings, the combined weight of the many header tanks requires substantial addition to the size of the foundation and framework of the building. In view of the bulk of these tanks, installation costs are increased. Accordingly, there was a need for a mains pressure flushing system which would avoid the need for those types of tanks.

Valves have been proposed to fulfill this need which, upon actuation, allow a predetermined volume of water to flow through the valve before automatically closing or stopping the flow of water. However, such values to date have usually been large, cumbersome and required specially adapted plumbing (such as larger diameter pipes, pressure regulators and extra valves) for their proper operation. They are also expensive in, themselves and expensive to, install. Such known valves may also be unable to deliver a sufficient volume of water to flush as required. They permit little adjustment for the volume of water to be delivered and cannot readily provide the well-known "dual flush" capability.

Australian patent number 577932 describes a self close flush valve which is intended to operate at lower than mains pressure as one of several similar valves, each servicing a separate toilet, where the water supply for each is one large header tank. This valve allows the delivery of a fixed volume of water and its particular advantage is stated to be that the volume of water delivered can be easily varied. This valve is, however, not appropriate for connection directly to a mains pressure water system.

That valve has a principal valve which controls the flow of water from the inlet to the outlet by the pressure of water in an inner chamber. By releasing the pressure of water in the inner chamber through a valve contained within the principal valve, the principal valve opens (allowing water to flow from the inlet through to the outlet). While that water flows through to the outlet, some of that water is diverted into the inner chamber which increases the water pressure in the inner chamber and thus causes the principal valve to close again.

Accordingly Investigations have been carried out in an attempt to provide an improved mains pressure valve to permit the delivery of a predetermined (although variable) volume of water from a mains pressure water system.

DESCRIPTION OF THE INVENTION

According to this invention, there is provided a mains pressure valve which comprises:

(a) a main chamber having an inlet for fluid and an outlet for fluid;

(b) a non-return valve located downstream of the outlet and adapted to provide resistance to fluid flowing therethrough;

(c) a piston located in the main chamber which is movable into and out of sealing engagement with the outlet of the main chamber and having an internal passageway which communicates between an upper portion of the main chamber and the inlet;

(d) a port in the upper portion of the main chamber above the piston which permits fluid to flow therethrough; and (e) a valve associated with the port to regulate the flow of fluid through the port.

In a preferred embodiment of the invention, the valve further comprises an inlet chamber communicating with the inlet of the main chamber. Additionally or alternatively, the valve further comprises a discharge chamber communicating with the outlet of the main chamber.

In another preferred embodiment or the invention, the valve further comprises a bypass passageway communicating between the port in the upper portion of the main chamber and the discharge chamber.

In another preferred form of the invention, a stop tap is located in the inlet chamber and adapted to vary the amount of water flowing through the inlet chamber into the main chamber. Further, the stop tap can be closed completely to prevent any flow of water through the valve. This feature would be particularly relevant for maintenance for example. Typically the stop tap may be raised or lowered to obstruct the flow of water from the mains pressure system into the main chamber. By allowing less water into the main chamber, less water is able to flow through the valve to the outlet during the period the valve is open.

In another preferred embodiment of the invention, the valve can be controlled by an actuation means which can be mechanical or electrical. The actuating means for the delivery of water may preferably be adapted so that there are two predetermined volumes of water which the valve may deliver (one being approximately double the other) to allow for the well known "dual flush" mode of operation. A "dual-flush" operation can be achieved by altering the period of activation of the mechanical means (such as holding the handle down for a short period before releasing it as opposed to a more push and release) or, in the ease of electrical means, by building a delay into the electronic circuitry so that the passage of water through the passageway bypass is allowed to continue for a longer period of time.

In another preferred form of the invention, the valve associated with the port to regulate the flow of fluid through the port may be opened or closed by either mechanical or electrical means. Typical mechanical means may be a handle, lever or push-button and the electrical means would normally incorporate a solenoid which may, for example, be activated by infra-red sensors or electrical buttons/switches.

In another preferred form or the invention, the distance or upward movement of the piston in the main chamber can be controlled by, for example, a spindle projecting into the upper portion of the main chamber. The spindle, indirectly controls the volume or water discharged by controlling the time for which the valve is "open" (where the valve permits the flow of water from the inlet to the outlet). The spindle can be lowered into the main chamber to decrease the distance through which the piston may rise which increases the volume or the upper portion or the main chamber. This volume determines the length or time for which the valve is open as water must fill the upper portion to force the piston downward to close the inlet.

In another preferred form or the invention, the discharge chamber is provided with an air-vent. The air-vent allows air into the discharger, chamber which enables water remaining in the discharge chamber to drain out. In use, this establishes an "air-break" between the toilet bowl and the valve to assist in the prevention of bacteria moving from the toilet bowl to the mains pressure water system.

With the preferred embodiments of the invention, the volume of water delivered can be controlled over a range sufficiently broad for normal use which is a substantial advance on the value currently available.

The body and components of the valve may be manufactured from any material which has sufficient strength, resilience and non-corrosive, properties to withstand the pressures involved (typically up to 2,000 Pa, although the valve will typically be made from an alloy such as brass.

DESCRIPTION OF DRAWINGS

The invention is now further illustrated with reference to the accompanying drawings in which.

Figure 1:
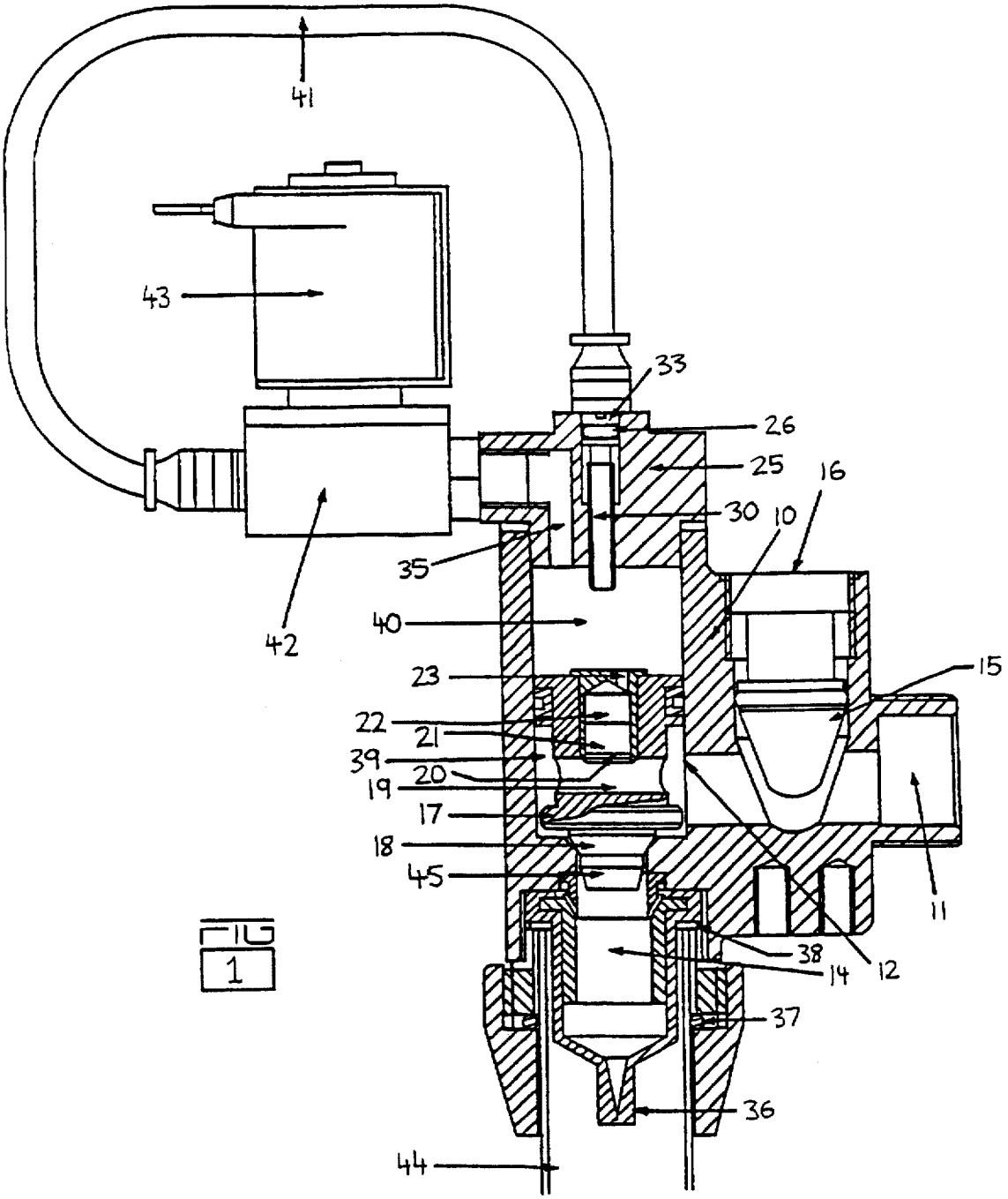
FIG. 1 is a cross-section of a valve according to one form of the invention.

In the drawings illustrating various embodiments of the invention, for convenience only like components are given the same numerical reference.

Figure 2:
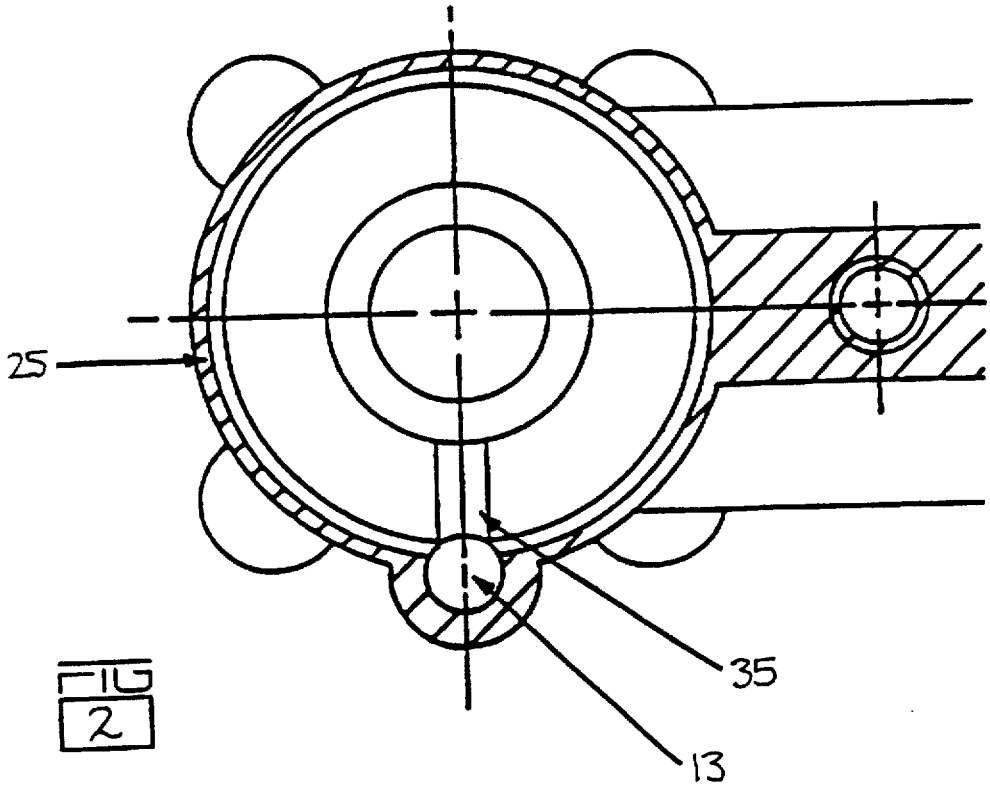
FIG. 2 is an exploded partial plan view of the valve of FIG. 1.

FIGS. 1 and 2 show a valve having a valve body 10 comprising principally an inlet chamber 11, a main chamber 12, a bypass passageway 13 (only shown in FIG. 2) and a discharge chamber 14.

Inlet chamber 11 contains a stop tap 15 which can be raised or lowered by turning bolt-head 16. Stop tap 15 may be lowered sufficiently to completely seal the remainder of the valve from the inlet chamber. However it is principally used to adjust the rate of flow of water entering the valve body 10.

The main chamber 12 contains a piston 17. The piston 17 has in its lower portion a rubberized surface 18 which engages with a corresponding seat formed in the valve body 10 to form a seal when the valve is in the closed position. This prevents water flowing from inlet chamber 11 to discharge chamber 14. Piston 12 has a depending projection 45 of slightly smaller diameter than the discharge chamber 14 to form a choke. Piston 12 also has a transverse passageway 19 and an axial passageway 20 which communicate with one another. A filter is located at one end of the axial passageway 20 where it meets with the transverse passageway 19. Two small flow valves 21 and 22 are also located in the axial passageway 20. Channel 23 of axial passageway connects valve 22 to the upper portion 40 of the main chamber 12 and is offset from the main axis of the valve so that it is not blocked by spindle 30 when the valve is open.

Water flows from the inlet chamber 11 into main chamber 12 and into transverse passageway 19. Thereafter a portion of the water flows into the axial passageway through flow valves 21 and 22, and through channel 23 into the upper portion 40. The flow valves regulate the amount of water permitted to flow into upper portion 40.

Situated above main chamber 12 is a bonnet 25 which, contains; a spindle 30 which projects into the main chamber 12. Bonnet 25 is partially located in the main chamber 12. (In the other form of the invention illustrated in FIG. 3, an "O" -ring 32 is necessary to seal the main chamber 12). The amount of the spindle projecting into the upper portion 40 may be adjusted by means of a bolt head 33. To prevent leakage of water from the bonnet 25, an "O" -ring 24 is located beneath bolt head 33. The spindle 30 projecting into the main chamber 12 controls the extent of upward movement of piston 17 and the volume of upper portion 40 when the valve is in the open position. That volume controls the period between actuation of the valve and the cessation of water Flow through the valve.

The bonnet 25 also has a port 35 leading from upper portion 40. A valve 42 is connected to the port 35 and also to a tube 41. Valve 42 is controlled by a solenoid nail 43 which is electrically actuated to open valve 42 for a predetermined period or time or times and then close. Tube 41 is connected at its other end to a passageway 13. Passageway 13 is a passageway which communicates with discharge chamber 14. An "O" -ring 37 assists in maintaining the connection between the discharge pipe 44 and the discharge chamber 14.

Figure 3:
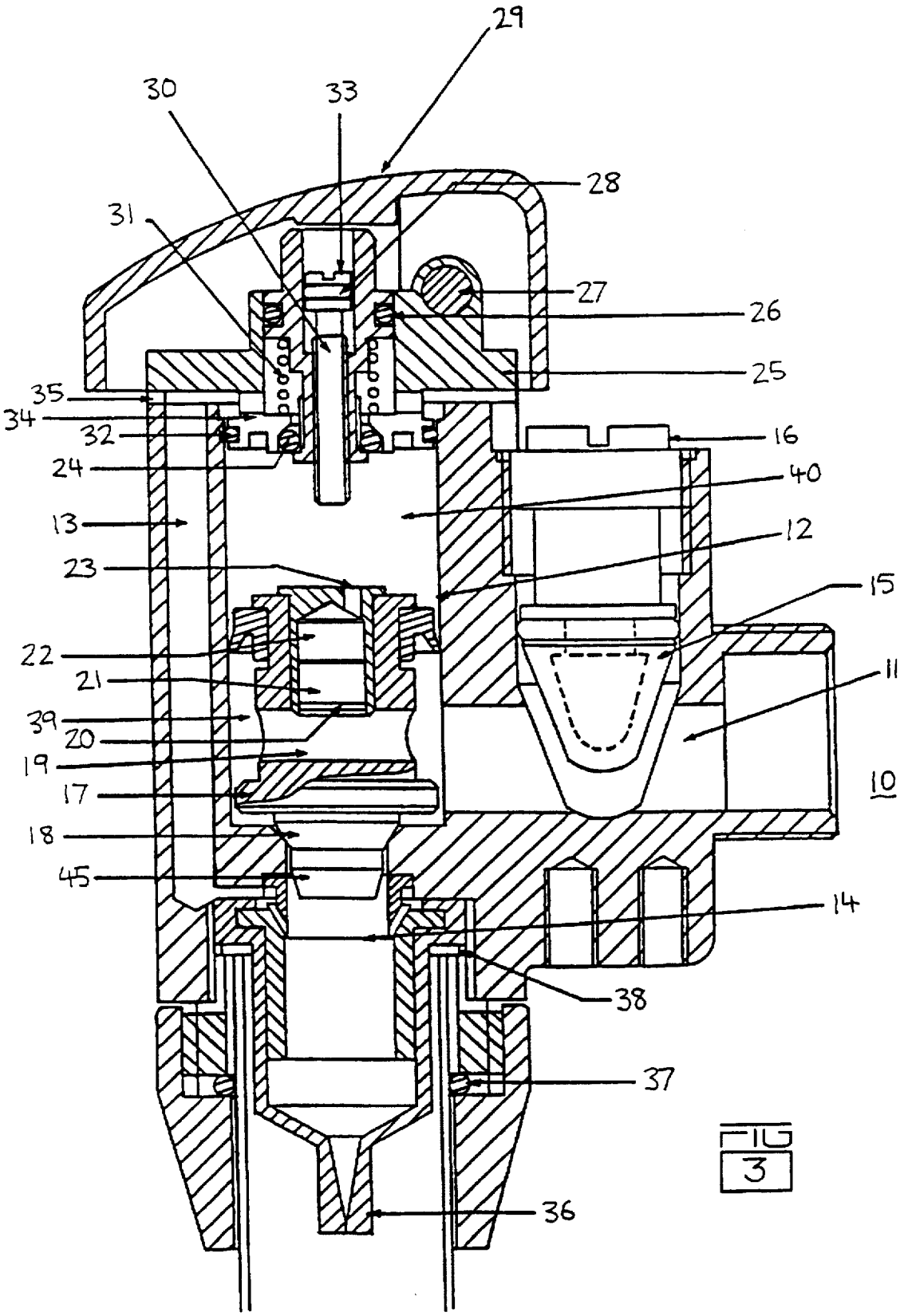
FIG. 3 is a cross-section of a valve according to another form of the invention.

In the other form of the invention illustrated in FIG. 3 the valve is actuated by mechanical means. A handle 29 is provided on bonnet 25. Upon depressing handle 29, water is able to flow from upper portion 40 of main chamber 12 through port 35 into the annular cavity around spindle 30 and then flow into passageway 13. The passageway 13 is opposite the inlet chamber 11 in contrast to FIGS. 1 and 2.

With either embodiments when the valve is in the closed position, inlet chamber 11 and main chamber 12 are filled with water. In this state, the total force exerted on the top of the piston 17 by the water contained in the upper portion 40 of the main chamber 12 is greater than the force exerted by the water in the lower portion 39 of the main chamber 12 because the piston 17 has greater surface area exposed to the upper portion 40. In this state, the valve is closed because seal 18 prevents water flowing from inlet chamber 11 to discharge chamber 14.

Upon actuation (by either mechanical or electrical means), water is permitted to flow from upper portion 40 through to port 35 and passageway 13 and into discharge chamber 14. Consequently, the force of the water on the top of piston 17 in the upper portion 40 of the main chamber becomes less than the force exerted by the water in the lower portion 39. This causes piston 17 to rise and permits water to flow from inlet chamber 11 through discharge chamber 14 and through the non-return valve 36. Water discharged from passageway 13 into discharge chamber 14 is drawn (by a venturi effect by the water Flowing from the inlet chamber 11 to discharge chamber 14) down discharge chamber 14. The non-return valve 36 provides some resistance to the water flowing through discharge chamber 14 which reduces any vacuum force created by the flowing of water through the outlet and which would otherwise cause piston 17, at normal operating pressures, to be prematurely drawn down, closing the valve prior to the action of the closing mechanism explained below. Further, where the non-return valve is constructed of flexible and elastic material, it can provide an appropriate degree of resistance over the range of water flow-rates experienced in the discharge chamber 14. In this state, water from inlet chamber 11 will still flow into channel 19, through filter 20, through flow valves 21 and 22 and then through channel 23 into upper portion 40.

Upon release of the actuating means (which in normal use would be very shortly after actuation), water is no longer able to pass through from upper portion 40 to passageway 13. Thus, water flowing through piston 17 into upper portion 40 will force piston 17 back down to its initial position in the "closed" state. As seal 18 nears its seat in main body 10, the flow of water from inlet chamber 11 to discharge chamber 14 will slowly decrease. Non-return valve 36 maintains some resistance to the water being discharged by elastically contracting due to the lower flow-rate (and thus lower pressure inside the non-return valve).

Projection 45, the choke, slows the downward movement of the piston 12 by further decreasing the water flow-rate through discharge chamber 14. This assists in the seal 18 coming to rest on its corresponding seat gently. A sudden or violent reseating of piston 12 would cause an undesirable noise and may also set up dangerous hydraulic vibrations. The flow of water though the valve finally stops upon seal 18 again forming a seal with its corresponding seat in main body 10 preventing the flow of water from inlet chamber 11 to discharge chamber 14. Air-vent 38 from discharge pipe 44 will enable any remaining water in discharge pipe 44 to drain away. This creates an air-break between the valve and the downstream end of discharge pipe 44.

The means for actuating the valve may be selected to provide alternate flushing options. For example appropriate electronic control for the solenoid 42 may permit selection of different volume of water to be discharged. Such electronic controls are well known.

In summary, a compact valve which is straightforward to use and relatively simple to install is provided which can be connected to a mains pressure water system to deliver a predetermined volume of water. The actuating means for the delivery of the water may be electrical or mechanical.

We claim In the claims:

1. A mains pressure valve which comprises:

(a) a main chamber having an inlet for fluid, an outlet for fluid and an upper portion;

(b) a discharge chamber downstream of and communicating with the outlet of the main chamber;

(c) a piston located in the main chamber which is movable into and out of sealing engagement with the outlet of the main chamber and having an internal passageway which communicates between the upper portion of the main chamber and the inlet;

(d) a non-return valve located in the discharge chamber, the non-return valve adapted to restrict fluid having been discharged from the outlet of the main chamber and through the non-return valve from flowing through the outlet and into the main chamber;

(e) a port in the upper portion of the main chamber above the piston which permits fluid to flow therethrough; and (f) a control valve associated with the port to regulate the flow of fluid through the port.

2. A valve according to claim 1 in which the non-return valve is constructed of a resilient flexible material such that greater flow of fluid through the outlet causes the non-return valve to expand to permit a greater flow of fluid through the non-return valve.

3. A valve according to claim 2 in which the non-return valve cooperates with the internal passageway such that there is sufficient flow of fluid through the internal passageway during movement, in use, of the piston towards the outlet of the main chamber to promote movement of the piston into a position of sealing engagement with the outlet.

4. A valve according to claim 2 further comprising at least one flow valve located in the internal passageway of the piston to regulate the passage of fluid through the internal passageway.

5. A valve according to claim 4 in which the non-return valve cooperates with the internal passageway and the flow valve such that there is sufficient flow of fluid through the internal passageway during movement, in use, of the piston towards the outlet of the main chamber to promote movement of the piston into a position of sealing engagement with the outlet.

6. A valve according to claim 4 further comprising piston stop located in the upper portion of the main chamber and opposite the piston, the piston stop being adapted to form a stop to movement of the piston, in use, away from the outlet and such that the piston stop does not obstruct or enter the internal passageway.

7. A valve according to claim 1 further comprising a piston stop located in the upper portion of the main chamber and opposite the piston, the piston stop being adapted to form a stop to movement of the piston, in use, away from the outlet and such that the piston stop does not obstruct or enter the internal passageway.

8. A valve according to claim 7 in which the piston stop is adjustable to control the amount of movement away from the outlet of the piston in the main chamber.

9. A valve according to claim 8 wherein the piston stop comprises a movable spindle projecting into the upper portion of the main chamber.

10. A valve according to claim 7 further comprising a bypass passageway communicating between the port in the upper portion of the main chamber and the discharge chamber.

11. A valve according to claim 7 further comprising an inlet chamber communicating with the inlet of the main chamber.

12. A valve according to claim 11 further comprising a stop tap located in the inlet chamber and movable to vary the amount of water flowing through the inlet chamber.

13. A valve according to claim 7 wherein the discharge chamber comprises an air-vent adapted to permit the entry of air into the discharge chamber downstream of the non-return valve to create an air-break.

14. A valve according to claim 7 wherein the piston further comprises a depending projection of slightly smaller diameter than the discharge chamber adapted to promote smooth movement of the piston into sealing engagement with the outlet.

15. A valve according to claim 7 further comprising mechanical or electrical actuation means to control fluid flow in and through the control valve.

16. A valve according to claim 1 further comprising a bypass passageway communicating between the port in the upper portion of the main chamber and the discharge chamber.

17. A valve according to claim 1 further comprising an inlet chamber communicating with the inlet of the main chamber.

18. A valve according to claim 1 wherein the discharge chamber comprises an air-vent adapted to permit the entry of air into the discharge chamber downstream of the non-return valve to create an air-break.

19. A valve according to claim 1 wherein the piston further comprises a depending projection of slightly smaller diameter than the discharge chamber adapted to promote smooth movement of the piston into sealing engagement with the outlet.

20. A valve according to claim 1 further comprising mechanical or electrical actuation means to control fluid flow in and through the control valve.

* * * * *